United States Patent [19]

Neary

[11] 4,287,806

[45] Sep. 8, 1981

[54] METHOD AND APPARATUS FOR TENSIONING A DRUM

[76] Inventor: John R. Neary, 54 School Ave., Kentville, Nova Scotia, Canada, B4M 2P9

[21] Appl. No.: 9,726

[22] Filed: Feb. 6, 1979

[51] Int. Cl.[3] ..... G10G 7/00

[52] U.S. Cl. ..... 84/458; 84/454

[58] Field of Search ..... 84/414, 454, 458; 73/139

[56] References Cited

U.S. PATENT DOCUMENTS

| | | | |
|---|---|---|---|
| 1,742,869 | 1/1930 | Mirfield | 84/419 |
| 2,013,938 | 9/1935 | Williams | 265/1 |
| 2,256,478 | 9/1941 | Hill | 73/139 |
| 3,091,866 | 6/1963 | Kachergis | 73/139 |
| 3,364,734 | 1/1968 | Wilson | 73/139 |
| 3,405,590 | 10/1968 | Pease | 84/458 |
| 3,412,638 | 11/1968 | Pease | 84/455 |
| 3,667,336 | 6/1972 | Itzler | 84/454 |
| 4,056,998 | 11/1977 | Rampton | 84/419 |

*Primary Examiner*—J. V. Truhe

*Assistant Examiner*—Shelley Wade

*Attorney, Agent, or Firm*—Moss, Bensette, Thompson, Squires

[57] ABSTRACT

A method of tensioning a musical drum is disclosed using a device for torquing the tension rods of the drum. The device has a housing having a central aperture and a concentric upper recess. The upper recess has a first partial annular groove and a concentric second annular groove. A shaft assembly is rotatably disposed in the central aperture and the upper recess and is adapted to receive at its lower end means for gripping a tension rod. The shaft assembly has a stop portion disposed in the first partial annular groove for positive rotation of the shaft assembly beyond a predetermined range of rotation of the housing. Biasing means disposed in the second annular groove is connected between the shaft assembly and the housing, for applying torque to a gripped tension rod upon turning the housing within said predetermined range. The drum is tensioned, and thus tuned to pitch, by torquing the drum tension rods to a predetermined torque.

2 Claims, 3 Drawing Figures

METHOD AND APPARATUS FOR TENSIONING A DRUM

This invention relates to a method of tensioning a drum, and to a low torque device for tensioning the drum by applying uniform torque to the tension rods of the drum.

The pitch of the musical beats which a drummer produces by tapping on the head of a drum depends on the amount to which the head is tightened by tension rods coupled between the head and the shell of the drum. The drummer must occasionally check that the head is properly tensioned or tuned because the amount to which the head is tightened either changes with, for example, changes in air temperature and air humidity or changes as the material from which the head is made deforms through creepage. Presently, the drummer checks that the head is properly tightened by tapping on the head, listening to the beats so produced, and adjusting each of the tension rods with a drum key until satisfied that the head is again properly tightened. An obvious disadvantage is that the drummer must depend solely on his senses of hearing and touch to decide when the drum head is correctly tightened.

In the present invention a device is provided which a drummer may use to ensure visually that the drum head is properly tightened. Once the drummer has initially tuned the drum to produce the pitch desired, he notes the amount to which the tension rods are torqued, and thereafter ensures that the drum is kept in tune by checking and adjusting the tension rods so that they are constantly torqued to this amount.

In one aspect of the invention, a device for torquing drum tension rods has a housing having a central aperture and a concentric upper recess. The upper recess has a first partial annular groove and a second annular groove. A shaft assembly is rotatably disposed in the central aperture and the upper recess. Means coupled to the lower end of the shaft are provided for gripping a tension rod. The shaft assembly has a stop portion disposed in the first partial annular groove. Biasing means disposed in the second annular groove and connected between the shaft assembly and the housing are provided for applying torque to a gripped tension rod upon turning of the housing. Also, means are located between the shaft assembly and the housing for indicating the amount of torque applied to the gripped tension rod.

According to another aspect of the invention there is provided a method of tensioning a drum, the drum having tension rods coupled between a drum head and a drum shell. The method comprises the steps of applying the gripping means of a torque device as described next above to the tension rods of the drum. The tension rods are first adjusted to initially tension the drum to produce the pitch desired and the amount to which the tension rods are torqued is noted. Thereafter, the housing of the torque device is first turned in a direction to partially loosen the tension rods, and then is turned in the opposite direction until the predetermined torque is indicated by the indicating means.

Advantages that can be achieved by use of the invention will become apparent from the following description of a preferred embodiment of the invention, condsidered in association with the accompanying drawings wherein.

Figure 1:
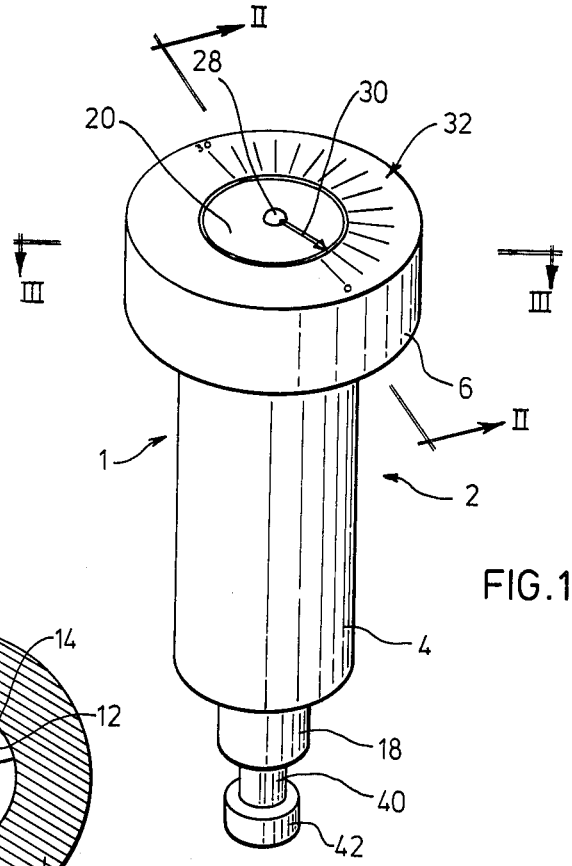
FIG. 1 is a perspective view of a preferred embodiment of the invention.

Reference is first made to FIG. 1 wherein a low torque device for torquing the tension rods of a drum constructed according to a preferred embodiment of the invention is indicated generally at 1. The torque device 1 is provided with a housing indicated generally at 2 having a handle portion 4 and a head portion 6.

Figure 3:
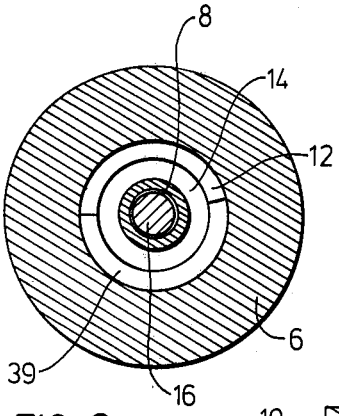
FIG. 3 is a sectional view along the line III—III of FIG. 1.
Figure 2:
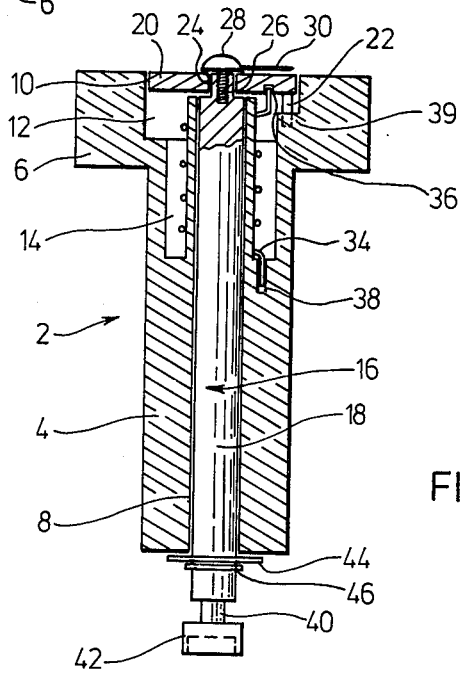
FIG. 2 is a sectional view along the line II—II of FIG. 1.

Turning next to FIG. 2, the housing 2 is provided with a central aperture 8 and an upper recess 10 concentric with the central aperture 8. The concentric upper recess 10 has, as is readily seen in FIG. 3, a first partial annular groove 12 and a second annular groove 14. The second annular groove 14 is preferably disposed interior of the first partial annular groove 12, but it will become obvious that it may instead be disposed exterior of the groove 12.

A shaft assembly indicated generally at 16 is rotatably disposed in the central aperture 8 and the concentric upper recess 10. The shaft assembly 16 comprises a shaft 18 rotatably disposed in the central aperture 8, a radially extending member 20 in the form of a cover plate disposed in the concentric upper recess 10 and connected to the upper end of the shaft 18 for conjoint rotation therewith, and a stop portion 22 in the form of a pin portion protruding downwardly from the radially extending member 20 and disposed in the first partial annular groove 12.

The radially extending member 20 is provided with a square aperture 24 for snugly receiving a square head 26 of the shaft 18. The square head 26 is bored and threaded to receive a threaded bolt 28. A pointer 30 is attached to the square head 26 by means of the threaded bolt 28. As is readily seen in FIG. 1, the pointer 30 is used to indicate, in association with a scale indicated generally at 32 on the upper surface of the head portion 6, the torque or inch-pounds or kilogram-centimeters imparted to a tension rod.

A biasing means 34 is disposed in the second annular groove 14 and connected between the housing 2 and the shaft assembly 16. Preferably, the biasing means 34 is a helical spring, which is generally more accurate than, for example, a flat coil spring for measuring low torque values. A suitable helical spring is a 1 inch diameter helical spring sold by Wallace and Barnes of Montreal, Canada. This spring, which has a generally linear relationship, requires a torque of approximately 24 kilogram-centimeters to be twisted through 180°. It will be apparent from FIG. 2 that the housing 2 defines a bushing on the inside of helical spring 34. This bushing has an outside diameter of approximately $\frac{3}{4}$ of an inch, and is used to locate and guide the spring and thus maintain the accuracy of the relationship between torque and torsional displacement or twisting.

One end of the helical spring is inserted into a recess 36 in the lower surface of the radially extending member 20 and the other end of the helical spring is inserted into a recess 38 in the lower surface of the second annular groove 14. Recesses 36 and 38 are disposed relative to each other such that pin portion 22 abuts land 39 when the torque device 1 is not in use. Consequently, as is readily seen in FIG. 1, when not in use, pointer 30 indicates a small initial amount of torque. This prevents rattle of the biasing means 34 and also improves its accuracy.

The lower end 40 of the shaft 18 of the shaft assembly 16 is adapted to receive socket means 42 for gripping a tension rod. As illustrated, socket means 42 has a square socket for use with a square headed tension rod, but it is obvious that the shaft 18 may be provided with socket means 42 for gripping a tension rod other than a square headed tension rod.

To assemble the torque device 1, one end of biasing means 34, which is preferably a helical spring, is inserted into the recess 38 in the lower surface of the second annular groove 14. A washer 44 is next slid onto the lower end of shaft 18, and a retaining ring 46 is snapped onto this lower shaft end. Shaft 18 is then inserted into the central aperture 8, so that square head 26 of the shaft 18 projects above aperture 8. Radially extending member 20 is then located over shaft 18, and the adjacent end of helical spring 34 is inserted into recess 36 in the lower surface of member 20. Member 20 is then rotated slightly to pre-load spring 34, and member 20 is lowered onto shaft 18 so that square head 26 is located in the square aperture 24 in the radially extending member 20. Finally, pointer 30 is attached to the head 26 of shaft 18 by means of the threaded bolt 28, the bolt 28 also securing the radially extending member 20 to the shaft 18.

Preferably, the housing 2 is injection moulded using polycarbonate, ABS, nylon or other plastic material and the shaft assembly 16, which comprises the shaft 18, the radially extending member 20 and the stop portion 22, is fabricated from light-weight aluminum or steel.

The drummer initially tensions the drum to produce the pitch desired and then notes the amount to which the tension rods are torqued. Thereafter, to tension a drum which for some reason, such as through use or environmental change, has become improperly tensioned, or to check that the drum is properly tensioned, the tension rods are gripped by socket means 42, and housing 2 is turned in a counter-clockwise direction (viewed from above) to partially loosen the tension rod and reduce the amount to which the tension rod is torqued. When the housing 2 rotates in a counter-clockwise direction, it will be appreciated that land 39 abuts against and pushes pin portion 22, so that torque device 1 acts directly as a wrench to untorque the tension rods.

Once the tension rods are thus partially untorqued, the housing 2 is then rotated in a clockwise direction (viewed from above) to torque the tension rod to the desired value. It will be appreciated that as housing 2 rotates in a clockwise direction, biasing means 34 causes the radially extending member 20 and the shaft 18 to rotate in a clockwise direction, thus torquing the tension rod, and that pointer 30 indicates when the desired torque value is attained.

It will be evident that a drummer, with a quick twist of his hand, can untorque the tension rods of a drum and then, with a quick twist of his hand in the opposite direction, can torque the tension rods to the desired value. Thus the drummer can conveniently visually ensure that the head of the drum is properly tensioned by ensuring that each of the tension rods is correctly torqued. The reason for partially loosening the tension rods before torquing to the desired value, is to overcome inaccuracies that may be caused by static friction should the rods become frozen or difficult to initiate turning.

Having described a preferred embodiment of the invention, it will be appreciated that modifications may be made to the structure and method described. For instance, the radially extending member 20, the stop portion 22, and the pointer 30 might be replaced by an outwardly projecting member attached to the head 26 of the shaft 18 and downwardly angled in the concentric upper recess 12. In such a case, one end of the helical spring could be attached to the shaft 18. Also, pointer 30 may be replaced by an indicator line marked on the top surface of radially extending member 20. However, the pointer described has the advantage that its position can be adjusted to calibrate torque device 1, if desired. It will also be appreciated that device 1 may be made for operation in the opposite direction to that described, should it be necessary to torque tension rods having left-hand threads.

From the above, it will be apparent that the present invention provides a very simple apparatus and method of tuning a drum, so that drums may be tuned visually and very quickly compared to prior art methods.

What I claim as my invention is:

1. A method of tuning a drum using a torque device having a housing with a rotatable shaft including gripping means and torque indicating means responsive to the torque applied to the rotatable shaft, the drum having tension rods coupled between a drum head and a drum shell for applying tension to the drum head the method comprising: applying said torque device to said tension rods by engaging said gripping means with each of said tension rods in turn; turning the housing of said torque device in a direction to partially loosen each tension rod; and then turning the housing in the opposite direction until a desired torque is indicated by the indicating means.

2. A method as claimed in claim 1, and further comprising the initial steps of applying said torque device to said tension rods, turning the torque device to produce the desired pitch of the drum, and noting the desired torque indicated by the torque device when the desired pitch has been obtained.

* * * * *